US008919367B2

(12) United States Patent
Dombrowski

(10) Patent No.: US 8,919,367 B2
(45) Date of Patent: Dec. 30, 2014

(54) APPARATUS AND METHOD FOR BLOCKING SEWER GAS

(71) Applicant: Thomas K. Dombrowski, Elk Grove Village, IL (US)

(72) Inventor: Thomas K. Dombrowski, Elk Grove Village, IL (US)

(73) Assignee: Disposal Guard Inc., Elk Grove Village, IL (US)

( * ) Notice: Subject to any disclaimer, the term of this patent is extended or adjusted under 35 U.S.C. 154(b) by 0 days.

(21) Appl. No.: 13/769,578

(22) Filed: Feb. 18, 2013

(65) Prior Publication Data

US 2014/0230903 A1 Aug. 21, 2014

(51) Int. Cl.

| | |
|---|---|
| ***E03B 3/40*** | (2006.01) |
| ***F16K 17/40*** | (2006.01) |
| ***E03C 1/298*** | (2006.01) |

(52) U.S. Cl.

CPC ..... *E03C 1/298* (2013.01); *Y10S 137/91* (2013.01)

USPC ..... 137/15.08; 137/68.11; 137/67; 137/910; 138/89; 4/679; 428/40.1; 428/42.2

(58) Field of Classification Search

USPC ..... 137/68.11, 910, 67, 15.08; 138/89; 4/679; 428/40.1, 42.2

See application file for complete search history.

(56) References Cited

U.S. PATENT DOCUMENTS

| | | | | |
|---|---|---|---|---|
| 2,266,270 | A * | 12/1941 | Roth | 215/317 |
| 2,773,554 | A | 12/1956 | Lindorf | |
| 3,289,875 | A | 12/1966 | Delamater | |
| 3,578,027 | A | 5/1971 | Zopfi | |
| 3,654,965 | A * | 4/1972 | Gramain | 138/89 |
| 4,429,568 | A | 2/1984 | Sullivan | |
| 4,506,705 | A | 3/1985 | Thompson | |
| 5,224,514 | A * | 7/1993 | Taylor | 138/89 |
| 5,507,501 | A | 4/1996 | Palmer | |
| 5,785,235 | A * | 7/1998 | Beatty | 228/42 |
| 6,085,363 | A | 7/2000 | Huber | |
| 6,701,965 | B1 | 3/2004 | Grace | |
| 6,792,977 | B2 * | 9/2004 | Presby | 138/89 |
| 7,112,358 | B1 * | 9/2006 | Hacikyan | 428/40.1 |
| 7,281,544 | B2 * | 10/2007 | Bocquart | 137/68.19 |
| 7,632,556 | B1 * | 12/2009 | Hacikyan | 428/40.1 |
| 8,006,324 | B2 * | 8/2011 | Ophardt et al. | 4/301 |
| D659,464 | S * | 5/2012 | Albers et al. | D7/391 |
| 8,413,689 | B1 * | 4/2013 | Taylor | 138/89 |
| 8,647,731 | B2 * | 2/2014 | Hacikyan | 428/40.1 |
| 2004/0238544 | A1 * | 12/2004 | Miller | 220/578 |
| 2012/0175003 | A1 * | 7/2012 | Shah | 138/89 |

FOREIGN PATENT DOCUMENTS

| | | | | |
|---|---|---|---|---|
| EP | 1118726 | A1 | 7/2001 | |
| JP | 05202544 | A * | 8/1993 | E03C 1/12 |

* cited by examiner

*Primary Examiner* — John K Fristoe, Jr.
*Assistant Examiner* — Minh Le
(74) *Attorney, Agent, or Firm* — Miller, Matthias & Hull LLP

(57) ABSTRACT

A device and method for preventing the backflow of undesirable gases from being drawn up through a drain line into a room. The device is particularly useful in applications where liquid flow into the drain is infrequent, resulting in little or no liquid left standing in the P-trap to serve as a gas barrier. When installed the device prevents the unwanted backflow of sewer gases into the room above. However, if water or a similar liquid is introduced into the drain line, the device dissolves, thereby allowing the liquid to pass down the drain line.

2 Claims, 2 Drawing Sheets

APPARATUS AND METHOD FOR BLOCKING SEWER GAS

BACKGROUND OF THE INVENTION

1. Field of the Invention

This invention patent relates to an apparatus and method for preventing the backflow of undesirable gases from being drawn up through a drain line and into a room. The invention is particularly useful in applications where liquid flow into the drain is infrequent, resulting in little or no liquid left standing in the P-trap to serve as a gas barrier.

2. Description of the Related Art

Sewer gas flowing back through a drain into a room is at best a nuisance and at worst a danger. Drain traps have been devised to hold water which prevent the backflow of sewer gas. However, some drains can run dry and the water in the drain trap evaporate, which can result in the backflow of sewer gas into the room. Conventional rubber drain stoppers can prevent or minimize the backflow of sewer gases, but they do not allow water to pass down the drain. The present invention is designed to solve this problem by providing an easy to install device which prevents the backflow of sewer gas but allows water to pass down the drain.

BRIEF SUMMARY OF THE INVENTION

The present invention is a device and method for preventing the backflow of gases from being drawn up through a drain line, the drain line having an interior surface that defines a drain line inner radius.

In one aspect of the invention a device is provided comprising a thin, substantially circular body and flanges projecting radially outward from the body. The body has a substantially circular periphery defining a body radius. The body radius is slightly less than the drain line inner radius. The flanges are circumferentially spaced around the body. Each flange projects radially outward from the periphery and is attached to the body along a bend line. Each bend line is substantially coincidental with (lies along the same circle as) the periphery. Each flange defines a flange radius greater than the body radius and greater than the drain line inner radius. An optional handle may extend upward from a central region of the body. The body and the flanges are made from a single sheet of gas impermeable but water soluble material to provide a temporary seal. Like the body and flanges, the bend lines are gas impermeable and retain their gas impermeability even when bent. An expandable, water-soluble sealant may be used to seal any gaps between the device and the drain line interior surface.

In another aspect of the invention a method for preventing the backflow of gases from being drawn up through a drain line is provided. The drain line has a drain wall defining a drain line inner radius. The method uses a gas impermeable but water soluble device having a substantially circular body and a plurality of flanges, the body having a periphery defining a body radius, each flange projecting radially outward from the periphery and being attached to the body along a bend line, and each flange defining a flange radius exceeding the drain line inner radius. The method comprises the steps of: (a) inserting the device into the drain line so that the periphery is in close proximity to or abutting relationship to the drain wall and the flanges are bent upwardly along the bend lines to form a friction fit with the drain wall; and (b) applying a gas impermeable but water soluble sealant between the device and the drain wall to seal any gaps between the device and the drain wall.

In another aspect of the invention a method of preventing the backflow of gases from being drawn up through a drain line having a drain wall defining an opening is provided, the method comprising the step of filling the drain line opening with an expandable, gas impermeable, water soluble foam.

DETAILED DESCRIPTION OF THE INVENTION

Figure 1:
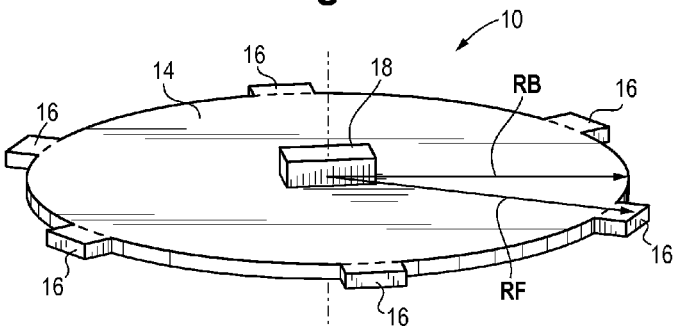
FIG. 1 is a perspective view of a device according to the invention.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

The invention is an apparatus and method of preventing the backflow of undesirable gases from being drawn up through a drain line and into a room. The invention is particularly useful in applications where liquid flow into the drain is infrequent, resulting in little or no liquid left standing in the P-trap to serve as a gas barrier.

Turning to the drawings, there is shown in FIG. 1 one embodiment of the present invention, a device 10 for preventing the backflow of undesirable gases from being drawn up through a drain line 12 and into a room. The drain line 12 has an interior surface 13 that defines a drain line inner radius RD. The device 10 comprises a substantially circular body 14, a plurality of discrete flanges 16 circumferentially spaced around the body 14 and a handle 18. The body 14 and the flanges 16 may be made from a single flat, rigid thin sheet of gas impermeable but water soluble material that is cut to shape.

The body 14 has a substantially circular periphery 20 defining a body radius RB. The body radius RB is slightly less than or equal to the drain line radius RD.

Each flange 16 projects radially outward from the periphery 20 and is attached to the body 14 along a bend line 22. Each flange 16 defines a flange radius RF greater than the body radius RB and even greater than the drain line radius RD. Although the figures show six flanges 16 there may be any suitable number of flanges 16.

The bend lines 22 are coincidental with the periphery 20. That is, the bend lines 22 may describe arcs that completely overlap a circle defined by the circular body periphery 20. The bend lines 22 may be perforated lines, score lines or any type of line that can be bent without removing the flanges 16 from the body 14. The bend lines 20 may be linear or arc shaped. Preferably the bend lines 20 retain their gas tight integrity (gas impermeability) even when bent during installation of the device 10 as described below.

The optional handle 18 extends upward from a central region of the body 14. The handle 18 may be any suitable size and shape, and may be permanently or removably affixed to the body 14.

The device 10 may be made from any suitable type of gas impermeable but water soluble material, including the starch based material used to make certain environmentally friendly foam packing pieces available commercially. When exposed to liquid water, the device 10 (and the sealant used to close any gaps between the device 10 and the drain line 12) dissolves or otherwise loses its integrity, allowing the water to flow down the drain 12. Preferably the handle 18 is made of the same water soluble material as the body 14 and the flanges 16, although the handle 18 does not necessarily have to be gas impermeable The device 10 or, more particularly, the body 14 may be any suitable size to fit closely within an existing drain line 12. The device 10 may be any suitable thickness, but preferably is at least one-sixty-fourth (1/64) of an inch thick and, more commonly, about one-quarter (1/4) of an inch thick. Preferably the body 14 and flanges 16 are cut from a flat sheet of suitable material, either before or after the bend lines 20 are created.

As discussed in more detail below, the device 10 may be used with an expandable foam sealant that seals any gaps between the device 10 and the drain wall interior surface 13.

In another aspect of the invention a method for preventing the backflow of gases from being drawn up through a drain line 12 is provided. The method uses a gas impermeable but water soluble device 10 like that described above. For example, the device 10 should have a substantially circular body 14 and a plurality of flanges 16, the body 14 having a body radius RB and a periphery 20, each flange 16 projecting radially outward from the periphery 20 and being attached to the body 14 along a bend line 22, the drain line 12 having a drain wall 24 defining a drain line inner radius RD, each flange 16 defining a flange radius RF exceeding the drain line inner radius RD. The method may comprise the following steps:

(a) inserting the device 10 into the drain line 12 so that the periphery 20 is in close proximity to the drain wall 24 and the flanges 16 are bent upwardly along the bend lines 22 to form a friction fit with the drain wall 24; and (b) applying a gas impermeable but water soluble sealant between the device 10 (including the periphery 20 and, if necessary, around the flanges 16) and the drain wall 24 to seal any gaps between the periphery 20 and the drain wall 24. Preferably the sealant is an expandable foam spray sealant.

The method may include the additional step, prior to step (a), of cutting out of a flat sheet of gas impermeable but water soluble material a substantially circular body 14 having a plurality of flanges 16 extending from the periphery 20 of the body 14, where the body 14 has a radius slightly less than or equal to the drain line inner radius.

Figure 2:
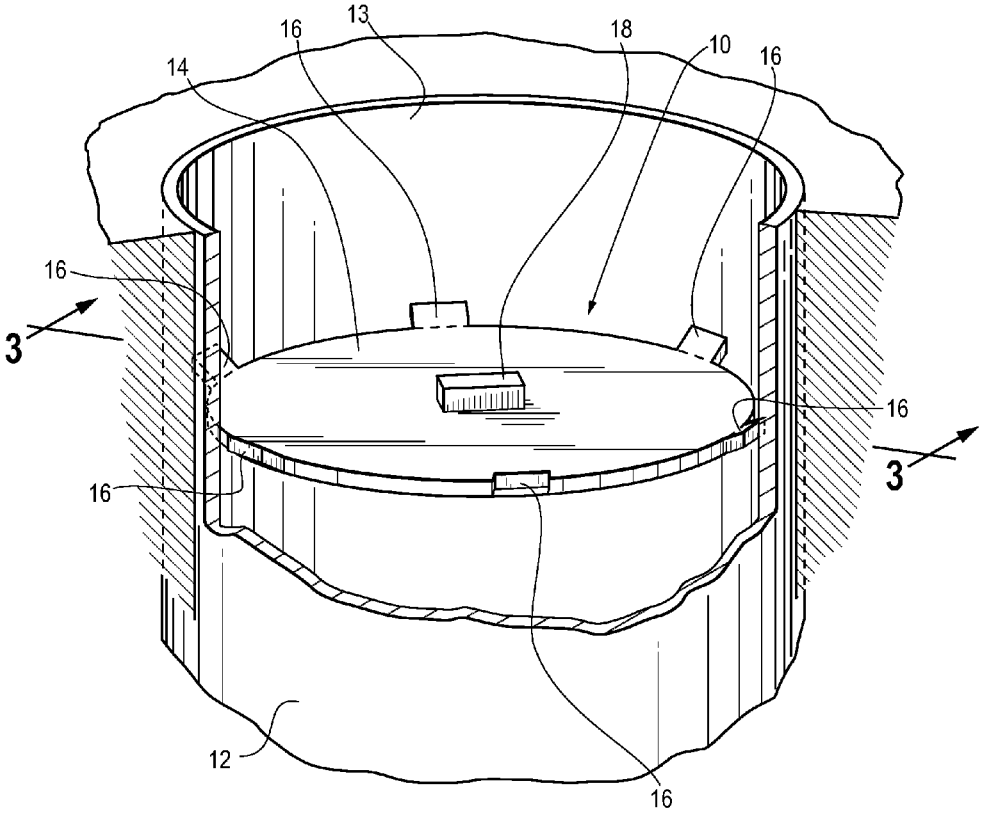
FIG. 2 is a perspective cutaway view of the device of FIG. 1 installed in a drain.
Figure 3:
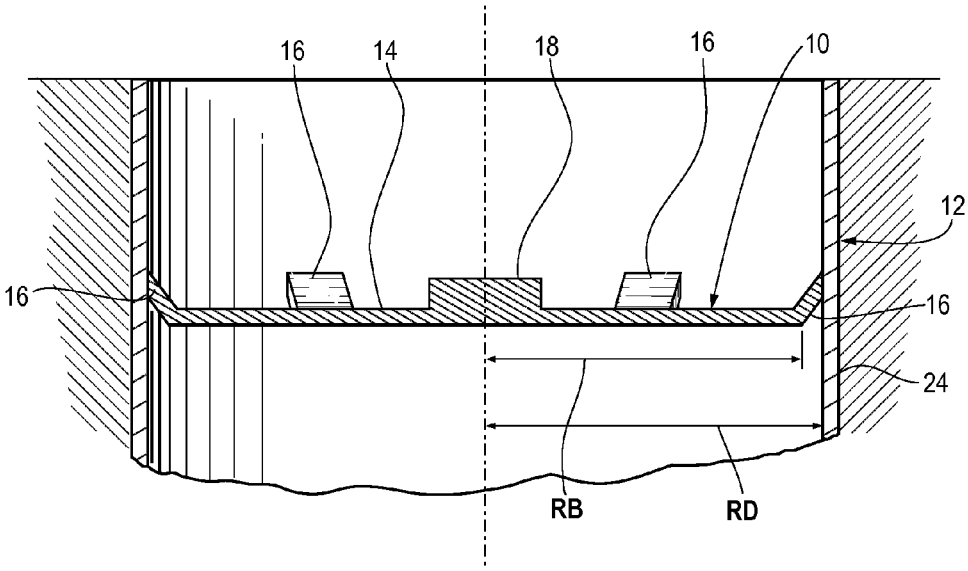
FIG. 3 is a cross-sectional view of the device and drain of FIG. 2 taken along line 3-3.

FIG. 2 is a perspective cutaway view of the device of FIG. 1 installed in a drain. FIG. 3 is a cross-sectional view of the device 10 and drain line 12 of FIG. 2 taken along line 3-3. When installed the body 14 is in close proximity to the drain wall 24 and may be touching the drain wall 24 in places, while the flanges 16 are bent upward to provide a friction fit with the drain wall 24. The sealant used to seal any gaps between the device 10 and the drain wall 24 is not evident in the figures. When installed the device 10 prevents the unwanted backflow of sewer gases into the room above. However, if water or a similar liquid is introduced into the drain line 12 the device 10 will immediately begin to dissolve, thereby allowing the liquid to pass down the drain line 12.

Figure 4:
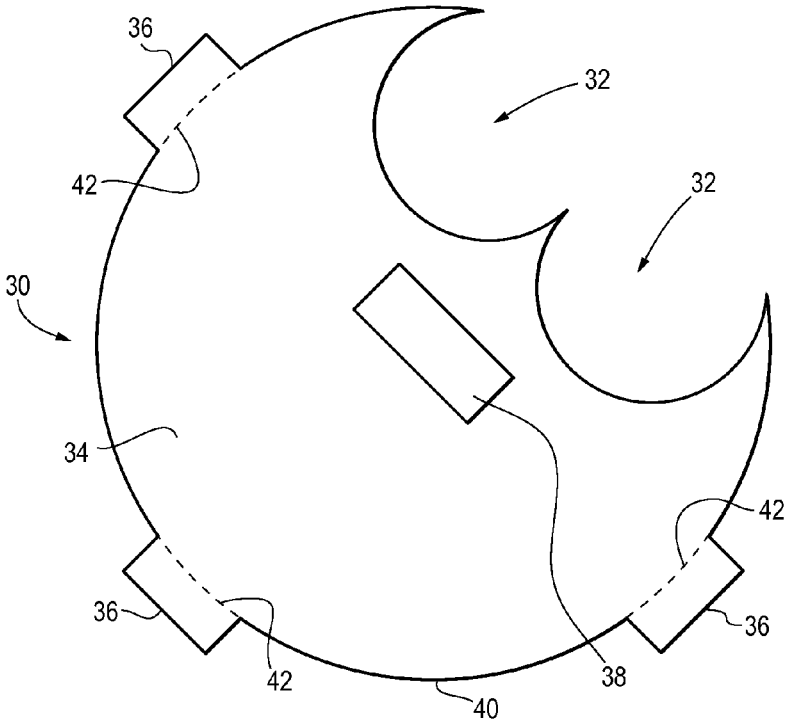
FIG. 4 is a top view of an alternative device according to the invention.

The present invention may be suitable for use in various household and commercial drains, including standard four inch diameter household utility drains. Sometimes one or more drain pipes extend into the drain, creating an obstruction that prevents the insertion of a circular disk. Accordingly, in another aspect of the invention, a disk may be provided having cutouts to accommodate these obstructions. For example and without limitation, FIG. 4 shows one such disk 30 comprising a substantially circular body 34 having a periphery 40, flanges 36 and a handle 38. Each flange 36 projects radially outward from the periphery 40 and is attached to the body 34 along a bend line 42. The bend lines 42 are coincidental with the periphery 40. The body defines 34 one or more cutouts 32 that accommodate pipes, tubes or other obstructions at the drain entrance. The cutouts 32 may be circular or any suitable shape, and may extend inward from the periphery 40 of the disk 30.

In another aspect of the invention, where the drain entrance is significantly obstructed by multiple pipes or other obstructions, the drain may be sealed using an expandable water soluble foam and no disk or disk-like device. In such a situation the expandable foam is sprayed or otherwise applied at or near the drain line entrance around the obstructions in a manner that temporarily seals the drain line and prevents sewer gas from entering the room in which the drain line is located.

The device 10 and/or the expandable sealant may include additives such as scent, anti-mold components, anti-bacterial agents and bug repellents. The expandable sealant may be dispensed from a container having a nozzle adapted to apply the sealant in a precise manner to minimize waste.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

I claim as my invention:

1. A method for preventing the backflow of gases from being drawn up through a drain line having a drain wall defining a drain line inner radius, the method using a gas impermeable but water soluble device having a substantially circular body and a plurality of flanges, the body having a periphery defining a body radius, each flange projecting radially outward from the periphery and being attached to the body along a bend line, each flange defining a flange radius exceeding the drain line inner radius, the method may comprising the steps of:

(a) inserting the device into the drain line so that the periphery is in close proximity to the drain wall and the flanges are bent upwardly along the bend lines to form a friction fit with the drain wall; and (b) after the inserting step, applying a gas impermeable but water soluble sealant between the periphery of the device body and the drain wall to seal any gaps between the device body and the drain wall.

2. The method of claim 1 comprising the additional step, prior to step (a), of:

cutting out of a flat sheet of gas impermeable but water soluble material a substantially circular body having a plurality of flanges 16 extending from the periphery of the body.

* * * * *